US006572400B2

(12) United States Patent
Noguchi et al.

(10) Patent No.: US 6,572,400 B2
(45) Date of Patent: Jun. 3, 2003

(54) ELECTRICAL CONNECTOR WITH FITTING DETECTING FUNCTION

(75) Inventors: Hirotaka Noguchi, Yokkaichi (JP); Kenji Inoue, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 30 days.

(21) Appl. No.: 09/993,776

(22) Filed: Nov. 27, 2001

(65) Prior Publication Data

US 2002/0064997 A1 May 30, 2002

(30) Foreign Application Priority Data

Nov. 27, 2000 (JP) ..... 2000-359738

(51) Int. Cl.[7] ..... H01R 3/00
(52) U.S. Cl. ..... 439/489
(58) Field of Search ..... 439/489, 345, 439/347, 350–355, 357, 358, 488, 490, 491, 527, 529, 95, 92

(56) References Cited

U.S. PATENT DOCUMENTS 5,120,255 A 6/1992 Kouda et al.
5,839,915 A * 11/1998 Ford et al. ..... 439/489
6,077,101 A * 6/2000 Garretson et al. ..... 439/352
6,126,480 A * 10/2000 Kawase et al. ..... 439/489
6,261,116 B1 * 7/2001 Ceru ..... 439/352

* cited by examiner

*Primary Examiner*—Jean F. Duverne
(74) *Attorney, Agent, or Firm*—Banner & Witcoff, Ltd.

(57) ABSTRACT

The invention improves the assembly operation of a connector provided with a detecting member. A female housing 20 is provided with a locking arm 33 capable of engaging with a locking protrusion 14 of a male housing 10. A detecting member 50 capable of moving in an anterior-posterior direction is attached to an upper face of this locking arm 33. The detecting member 50 has an operating member 53 joined to a posterior end of a main body 51 by a hinge 52. A finger engages from the posterior with the operating member 53 to push in the detecting member 50, this detecting member 50 being pushed in its direction of fitting in an inclined downwards direction. When the detecting member 50 is in a waiting position, the operating member 53 thereof is located above a posterior portion of the upper face of the locking arm 33. This posterior portion of the upper face of the locking arm 33 has a guiding inclined face 44 formed thereon, this guiding inclined face 44 being inclined downwards in the pushing-in direction. When the detecting member 50 is being moved from the waiting position to a detecting position, the operating member 53 slides along the guiding inclined face 44, this smoothly guiding the movement thereof.

9 Claims, 9 Drawing Sheets

ELECTRICAL CONNECTOR WITH FITTING DETECTING FUNCTION

TECHNICAL FIELD

The present invention relates to an electrical connector provided with a fitting detecting function.

BACKGROUND TO THE INVENTION

One example of a conventional connector provided with a fitting detecting function is described in JP-3-285280. As shown in FIGS. 9 and 10 of this specification, this connector is provided with a female housing 1 and a male housing 2 capable of mutually fitting together. The female housing 1 has an inclinable locking arm 4 capable of engaging with a locking member 3 of the male housing 2, and a detecting member 5 that is attached in a waiting position from the posterior, and is capable of sliding in an anterior-posterior direction along an upper face of this female housing 1. The detecting member 5 extends along the locking arm 4, and is provided with a detecting arm 7 which engages with a hole edge of a locking hole 6 thereof. The detecting arm 7 inclines together with the locking arm 4, this movement of the detecting arm 7 preventing the detecting member 5 from moving from the waiting position towards the anterior when the two housings 1 and 2 are not yet fitted together or are being fitted together (see FIGS. 10(*a*) and 10(*b*)). When the two housings 1 and 2 have reached a correct fitting position, only the locking arm 4 returns to its original position, the locking member 3 engaging with the hole edge of the locking hole 6. The detecting arm 7, which makes contact with a lower face of the locking member 3, remains in an inclined state, and is released from its state of engagement with the locking arm 4 (see FIG. 10(*c*)). Then the detecting member 5 is pushed to the anterior into a detecting position (see FIG. 10(*d*)).

That is, the ability or inability of the detecting member 5 to move allows one to detect whether the two housings 1 and 2 are in a half-fitted state or a correctly fitted state.

When the fitting operation of the above connector is to be performed, the operator usually uses one hand to gather together electric wires 8 that are lead outwards from a posterior end of the female housing 1, the female housing 1 being fitted to the male housing 2 while this bundle of electric wires 8 is in a grasped state. When the detecting member 5 is to be pushed to the detecting position, the hand grasping the electric wires 8 temporarily releases them. Then, the posterior end face of the detecting member 5 is pushed in a straight line from the posterior, in a direction that is horizontal and is the fitting direction of the two housings 1 and 2.

In this manner, the fitting operation of the two housings 1 and 2 and the pushing-in operation of the detecting member 5 are performed as two discontinuous actions. As a result, operability is poor. Moreover, as shown in FIG. 10(*c*), if the operator continues to grasp the electric wires 8 after ending the fitting operation, and he uses his thumb A (since this is not being used to grasp the electric wires 8) to push the detecting member 5 in an inclined manner (from above at the posterior), this pushing direction (shown by the arrow Y) is such that, when the detecting member 5 moves, it faces in a direction that is orthogonal to that of the upper face of the female housing 2. This renders it difficult for the detecting member 5 to move smoothly, and the operability thereof is worsened.

The present invention has taken the above problem into consideration, and aims to present a connector provided with a detecting member wherein the assembly operation is improved.

SUMMARY OF THE INVENTION

According to the invention there is provided an electrical connector comprising a first connector housing engageable in a fitting direction with a mating connector housing, said first connector housing having at one side a resilient latching arm extending in the fitting direction and for engagement with the mating connector housing, said arm bending as the connector housings approach in the fitting direction and having a substantially unbent state in the fully engaged condition of the connector housings, and a detecting member being provided on said latching arm for relative movement in the fitting direction from a posterior waiting position to an anterior final position, the detecting member being maintained in the waiting position by abutment with one of said latching arm and first connector housing, and being released from abutment in the fully engaged condition of said connector housings, wherein said latching arm includes a surface inclined with respect to the fitting direction and facing towards the anterior, said detecting member being guided by said first connector housing and being slidable on the inclined surface, an operating portion of the detecting member being adapted for contact by a human finger or thumb whereby said operating portion is urged against and along the inclined surface on movement from the waiting position to the final position.

In such an arrangement the operating portion can be urged generally downward and inward of the connector whilst gripping the connector wires, in a natural manner corresponding to a gripping action of the hand. Operability is substantially improved.

In a preferred embodiment the detecting member comprises a hinged element comprising a main body portion and an operating portion connected by a transverse hinge.

The main body portion preferably slides on an anterior surface of the latching arm, and which extends generally parallel to the fitting direction. In a preferred embodiment the first connector housing includes upstanding sidewalls between which the latching arm and detecting member are located. Preferably the operating portion is above the top of the sidewalls only in the waiting position.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
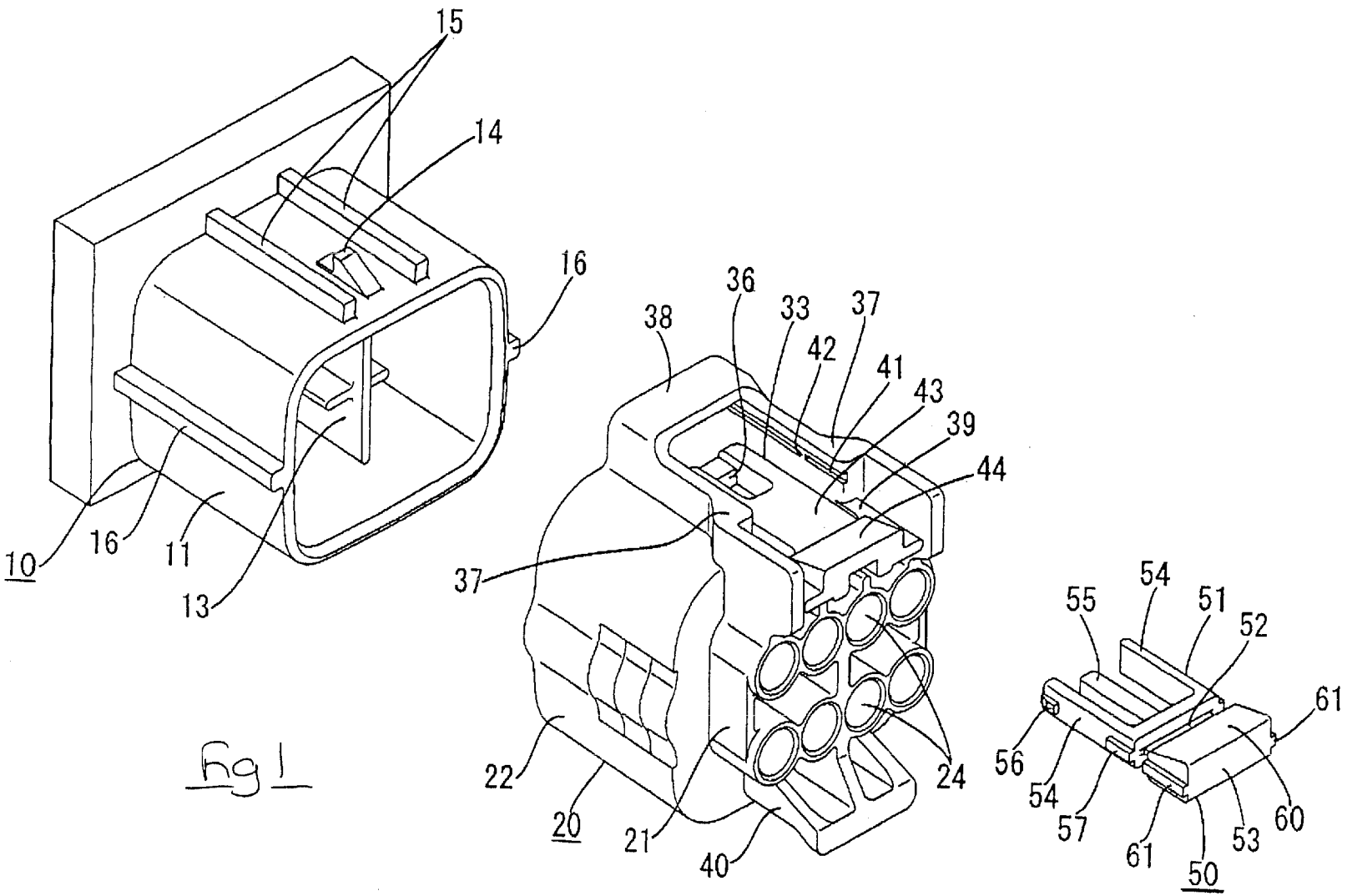
FIG. 1 is a diagonal view of two housings and a detecting member of an embodiment of the present invention.

An embodiment of the present invention is described below with the aid of FIGS. 1 to 8. As shown in FIG. 1, a connector of the present embodiment has a male connector housing 10, and a female connector housing 20 which is provided with a locking arm 33 and which fits with the male housing 10. A detecting member 50 is attached to the female housing 20. In the following description, the fitting face sides of the two housings 10 and 20 are designated the anterior sides. Moreover, the up-down direction is taken with reference to FIGS. 1, 2, 5, 6, and 7.

Figure 2:
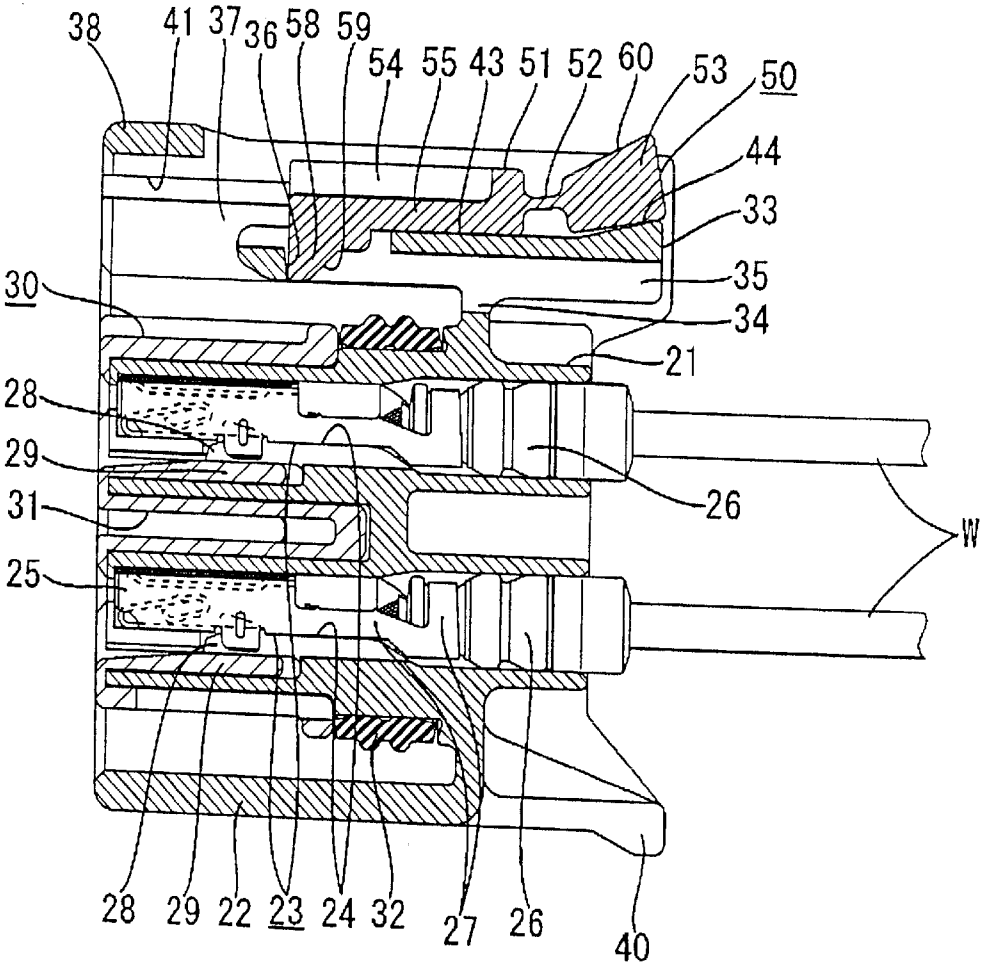
FIG. 2 is a side cross-sectional view of a male housing, and a female housing having the detecting member attached thereto in a waiting position.
Figure 2:
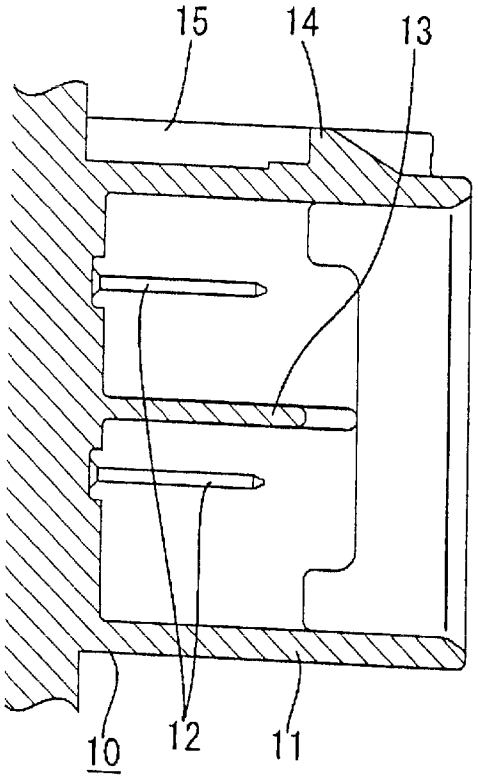

As shown in FIGS. 1 and 2, the male housing 10 is formed in a unified manner with other apparatus, and is provided with a cylindrical hood 11 that protrudes towards the anterior. Eight tab-shaped male terminal fittings 12 protrude towards the anterior from an innermost face of the hood 11. Grid-like leak-preventing ribs 13 protrude from the innermost face of the hood 11, these partitioning the male terminal fittings 12 from one another. Anterior ends of these leak-preventing ribs 13 are located further to the anterior than anterior ends of the male terminal fittings 12. A locking protrusion 14 capable of engaging with the locking arm 33 of the female housing 20 protrudes upwards from an upper face of the hood 11. This locking protrusion 14 is higher than an anterior end portion of the locking arm 33 (to be described). A posterior end of the locking protrusion 14 forms a protruding member which is slightly higher than an outer face of the hood 11. One rail-shaped guiding rib 15 is located to each side of the locking protrusion 14 (i.e., the guiding ribs 15 constitute a pair). When the fitting operation takes place, the locking arm 33 is inserted between the two guiding ribs 15, this guiding the insertion operation of the locking arm 33. Moreover, a pair of guiding ribs 16 are formed on outer side faces of the hood 11, these entering guiding grooves of the female housing 20 when the fitting operation takes place. The guiding ribs 16 guide the fitting operation of the two housings 10 and 20.

The female housing 20 is provided with a terminal housing member 21 capable of fitting with an inner side of the hood 11 of the male housing 10, and an outer cylindrical member 22 capable of fitting with an outer side of the hood 11. An upper and a lower row of cavities 24, four thereof being formed in a widthwise direction in each row, are formed within the terminal housing member 21 at locations corresponding to the male terminal fittings 12 of the male housing 10. Female terminal fittings 23, which are joined to electric wires W, are inserted from the posterior into these cavities 24. The anterior half of the terminal housing member 21 is divided so as to form the cavities 24. Each female terminal fitting 23 is provided at its anterior with a box-shaped joining member 25 capable of joining in a conducting manner with one of the male terminal fittings 12. At its posterior, each female terminal fitting 23 is provided with a barrel member 27 which is attached by crimping to a rubber stopper 26, this rubber stopper 26 fitting with a covered end of one of the electric wires W. The female terminal fittings 23 are housed within the cavities 24, each female terminal fitting 23 engaging with a lance 28 which protrudes from a lower face of each cavity 24, this preventing the removal of the female terminal fitting 23. The rubber stoppers 26 fit tightly with an inner circumference face of each cavity 24, thereby water-proofing the cavities 24. Each electric wire W is led outwards towards the posterior from a posterior end of the terminal housing member 21. A front retainer 30 covers an anterior face side of the terminal housing member 21, this front retainer 30 being provided with bending regulating members 29 which regulate the bending of the lances 28, these bending regulating members 29 being inserted into spaces maintained below the lances 28. Grid-like receiving grooves 31, which are capable of receiving the leak-preventing ribs 13 of the male housing 10, are formed on an anterior face of the front retainer 30. Further, the front retainer 30, which is located at the outer circumference face of the terminal housing member 21, has a rubber ring 32 fitted to its posterior end. When the male housing 10 is fitted, an inner circumference face of the hood 11 thereof fits tightly with an outer circumference face of this rubber ring 32, thereby water-proofing the two housings 10 and 20.

The locking arm 33, which is see-saw like, protrudes from a central location relative to the widthwise direction of the upper face of the terminal housing member 21. This locking arm 33 has an arm member 35 that extends in an anterior-posterior direction along the fitting direction of the two housings 10 and 20 from a supporting member 34 joining with the upper face of the terminal housing member 21. The arm member 35 can be inclined resiliently in an up-down direction with the supporting member 34 serving as its centre. The posterior portion of the arm member 35 is wider, in the widthwise direction, than the anterior end thereof (see FIG. 3). A lower face of the anterior end of the locking arm 33 is tapered, this guiding the anterior end portion of the locking arm 33 over the locking protrusion 14 when the two housings 10 and 20 are being fitted together. The locking arm 33 inclines resiliently while it rises over the locking protrusion 14 (see FIG. 5). A locking hole 36 passes through (from top to bottom) the anterior end of the locking arm 33. The locking protrusion 14 of the male housing 10 can be inserted into this locking hole 36 when the two housings 10 and 20 have been correctly fitted together, and a posterior end face of the locking protrusion 14 engages with a hole edge of the locking hole 36 at an anterior side thereof (see FIG. 6). In this locked state, the anterior end portion of the locking arm 33 makes contact with the protruding member at the posterior side of the locking protrusion 14, this maintaining the locking arm 33 in a slightly inclined state.

Figure 3:
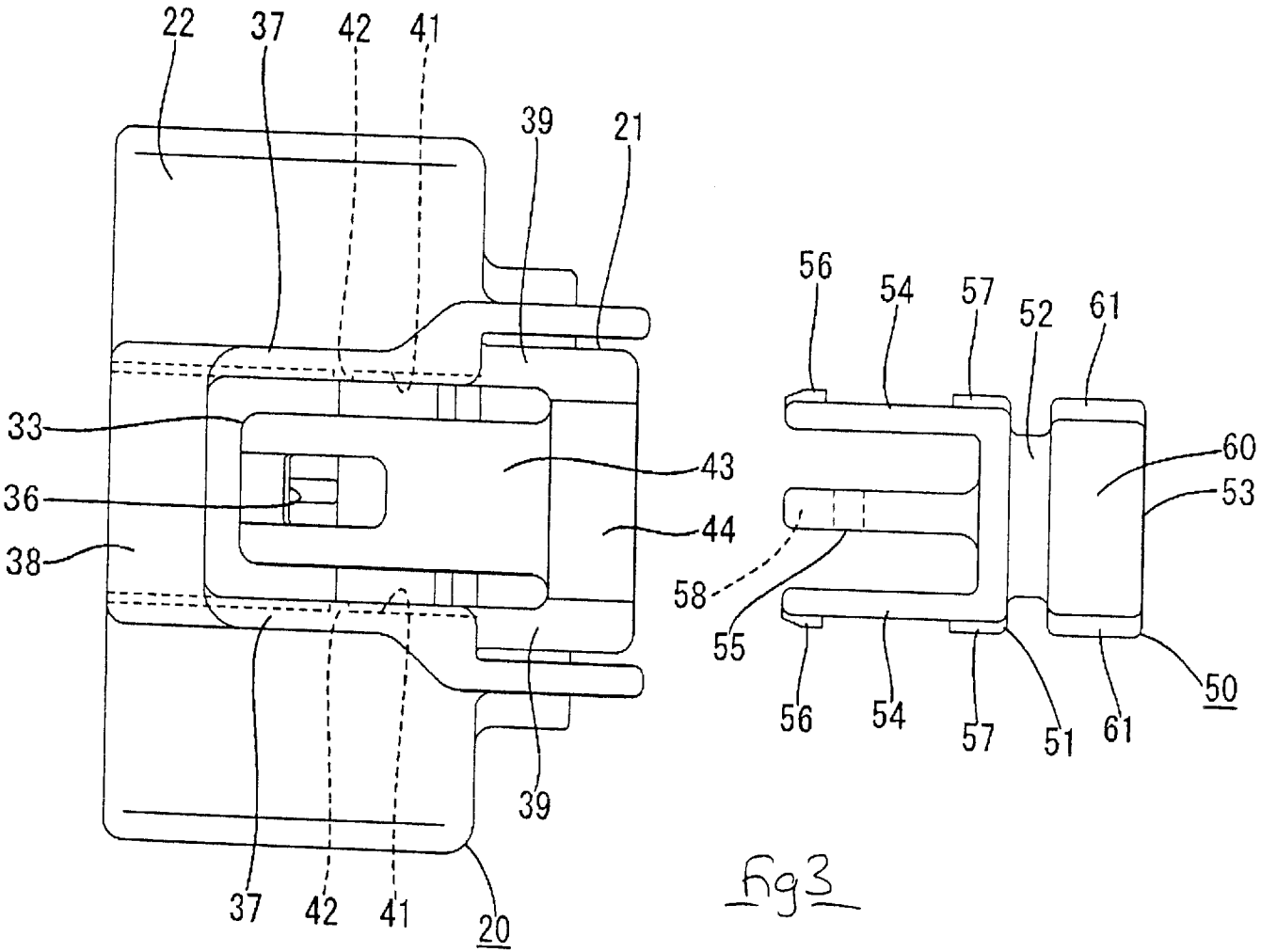
FIG. 3 is a plan view of the female housing and the detecting member.

As shown in FIGS. 1 and 2, the outer cylindrical member 22 joins with the terminal housing member 21 at a location somewhat to the posterior relative to the centre (in the lengthwise direction) of this terminal housing member 21. This outer cylindrical member 22 has a cylindrical shape which encloses the outer circumference face of the terminal housing member 21 with the exception of a specified area on the upper face thereof (the area with the locking arm 33, and the area surrounding it). A pair of protecting walls 37 are formed on an upper portion of the outer cylindrical member 22, the locking arm 33 being located between these two protecting walls 37. Seen from the side, the two protecting walls 37 have a size sufficient to cover the entire locking arm 33, and the posterior ends of these protecting walls 37 are located further to the posterior than the posterior end of the locking arm 33. Upper portions of anterior ends of the protecting walls 37 are mutually joined by a bridging member 38. Further, as shown in FIG. 3, a pair of strengthening members 39 protrude towards the sides from both side faces of the wider posterior portion of the locking arm 33. The anterior ends of these strengthening members 39 join with the protecting walls 37. The joining portions of the protecting walls 37 and the strengthening members 39 (i.e., in the lengthwise direction) are located at approximately the same location as the supporting member 34 of the locking arm 33. Consequently, the centrally located supporting member 34 is supported on both sides by the strengthening members 39, thereby increasing its resilience when the locking arm 33 is to be inclined.

A finger-engaging member 40 protrudes towards the posterior from a posterior end face of a lower portion of the outer cylindrical member 22 (i.e., at a location opposite, in the up-down direction, the locking arm 33). When the female housing 20 is to be fitted to the male housing 10, a finger B (for example, an index finger), at the anterior side of the hand holding the bundle of electric wires W led out from the posterior end of the female housing 20, engages with a lower face of this finger-engaging member 40 (see FIG. 5). The finger-engaging member 40 has a shape whereby the lower face at a posterior end thereof protrudes downwards at its posterior. Consequently, the finger B can easily engage therewith. Moreover, an upper face of the finger-engaging member 40 joins with a lower face of the terminal housing member 21.

The detecting member 50 is attached from the posterior to an upper face of the locking arm 33. The detecting member 50 has a configuration whereby a thin hinge 52 joins a main body 51 to an operating member 53. A finger A (for example, a thumb) engages with this operating member 53 to move the detecting member 50 in an anterior-posterior direction along the upper face of the locking arm 33, moving the detecting member 50 between a posteriorly-located waiting position and an anteriorly-located detecting position. The operating member 53 is somewhat narrower in width than the main body 51.

As shown in FIG. 3, the main body 51 has a pair of guiding arms 54 and an engaging arm 55 provided between the guiding arms 54, all these extending in an anterior-posterior direction (i.e., in the fitting direction of the two housings 10 and 20). The guiding arms 54 and the engaging arm 55 mutually join at their posterior ends. The guiding arms 54 are separated from one another by a space corresponding to the width of the locking arm 33. Furthermore, these guiding arms 54 are capable of bending in a direction whereby they approach the centrally located engaging arm 55. Posterior stopping protrusions 56 and anterior stopping protrusions 57 protrude outwards (towards the side) from side faces of the guiding arms 54 at anterior ends and posterior ends thereof respectively. While the detecting member 50 is being attached at the upper side of the locking arm 33, these protrusions 56 and 57 are inserted into guiding grooves 41 formed in the protecting walls 37, this guiding the anterior-posterior movement of the detecting member 50. The engaging arm 55 is capable of moving resiliently in an up-down direction, i.e., in the direction of movement of the locking arm 33. An engaging protrusion 58 protrudes downwards from a lower face at an anterior end of the engaging arm 55.

Figure 4:
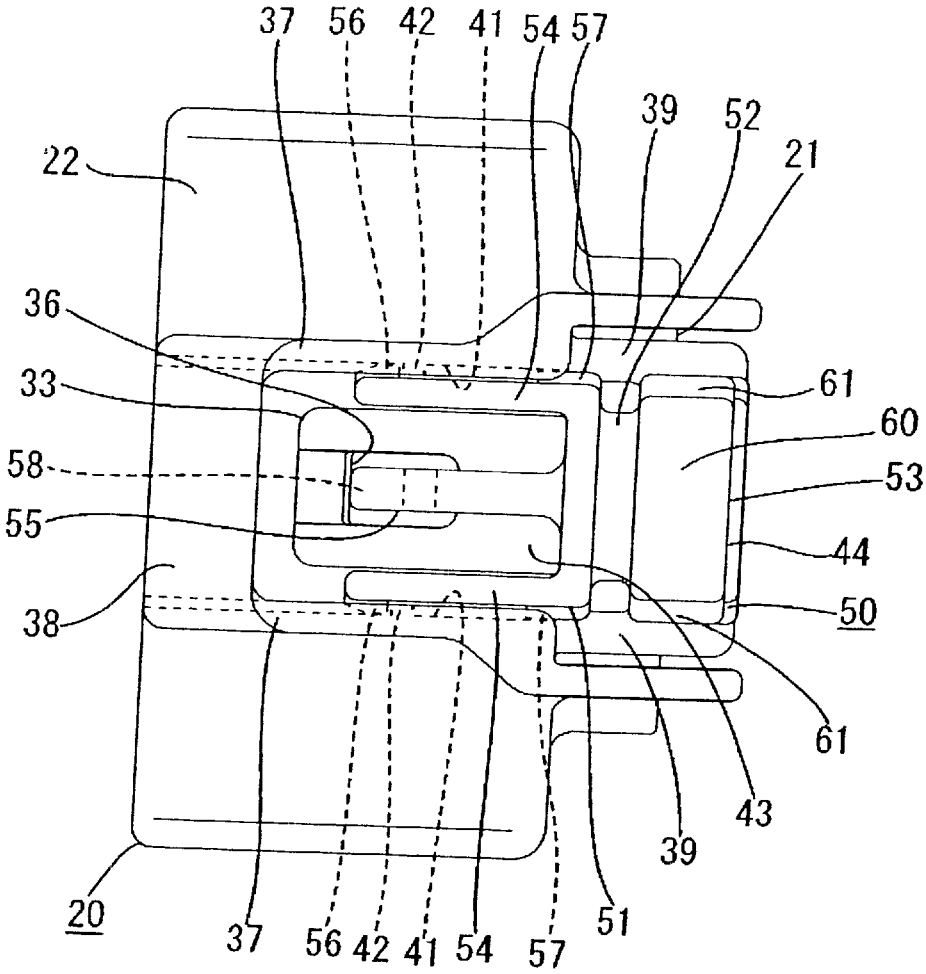
FIG. 4 is a plan view showing the detecting member attached, in the waiting position, to the female housing.

While the detecting member 50 is being attached in the waiting state to the female housing 20, the posterior stopping protrusions 56 of the guiding arms 54 engage with stopper protrusions 42 protruding part-way along the guiding grooves 41, this causing the guiding arms 54 to bend temporarily and then return to their original position. Then, as shown in FIG. 4, posterior end faces of the posterior stopping protrusions 56 engage with anterior end faces of the stopper protrusions 42. Further, anterior end faces of the posterior stopping protrusions 56 are taper shaped so as to guide the guiding arms 54 in their bending direction. Moreover, the guiding arms 54 are located at a height which differs from that of the locking arm 33 when this locking arm 33 is in its natural state. Consequently, the guiding arms 54 do not interfere, when bent, with the locking arm 33. As shown in FIG. 2, the engaging protrusion 58 of the engaging arm 55 is inserted into the locking hole 36, an anterior end face of this engaging protrusion 58 engaging with the hole edge at the anterior side of the locking hole 36. By this means, the detecting member 50 is prevented from moving from the waiting position in an anterior or posterior direction. Furthermore, in this waiting position, anterior end portions of the anterior stopping protrusions 57 are inserted into the guiding grooves 41 (see FIG. 4). If the locking arm 33 is inclined resiliently when the detecting member 50 is in the waiting state, the engaging arm 55, which is making contact with the upper face of the locking arm 33, bends resiliently therewith, moving in the same direction and to the same extent (see FIG. 5). Moreover, as shown in FIG. 4, the guiding arms 54 are located (relative to the widthwise direction) between the locking arm 33 and the protecting walls 37. Consequently, these guiding arms 54 do not interfere with the upwardly-moving locking arm 33.

When the two housings 10 and 20 have been correctly fitted together, the locking protrusion 14 is in an inserted state within the locking hole 36 of the locking arm 33. When the engaging protrusion 58 of the engaging arm 55 rises over the locking protrusion 14, the engaging protrusion 58 and the locking protrusion 14 are released from their engaged state (see FIG. 6). From this state, the detecting member 50 is moved into the anteriorly-located detecting position, and the anterior end faces of the anterior stopping protrusions 57 of the guiding arms 54 engage with posterior end faces of the stopper protrusions 42 (see FIG. 8). The engaging protrusion 58 of the engaging arm 55 is located to the anterior of the anterior end portion of the locking arm 33, a taper-shaped posterior end face 59 of the engaging protrusion 58 engaging with the anterior end face of the locking arm 33 (see FIG. 7). By this means, the detecting member 50 is prevented from moving from the detecting position in an anterior or posterior direction. The engaging protrusion 58 has a stepped shape whereby its anterior end protrudes further downwards than its posterior end. When the detecting member 50 is in the detecting position, a lower face at the posterior end of the engaging protrusion 58 makes contact with the anterior end of the upper face of the locking arm 33, this maintaining the engaging arm 55 in the same type of slightly bent state as the locking arm 33. Since the anterior portion of the posterior end face 59 of the engaging protrusion 58 is tapered, this posterior end face 59 can be released from its engaged state with the anterior end face of the locking arm 33 by exerting a force on the detecting member 50, this force being exerted towards the posterior and exceeding a specified limit. That is, the two are in a semi-locked state. Furthermore, when the detecting member 50 is in the detecting position, the anterior end portions of both the guiding arms 54 and the engaging arm 55 have entered below the protecting walls 37.

As shown in FIGS. 2 and 3, the upper face of the locking arm 33, excepting the wider posterior portion thereof, has a parallel face 43 formed thereon. This parallel face 43 is approximately parallel to the fitting direction when the locking arm 33 is in its natural state. A guiding inclined face 44 is formed along the entirety of the wider posterior portion of the locking am 33, this guiding inclined face 44 being inclined, relative to the fitting direction, upwards towards the posterior. The parallel face 43 and the guiding inclined face 44 join with one another. When the detecting member 50 has been attached in the waiting position, the main body 51 thereof is located above the parallel face 43 and the operating member 53 is located above the guiding inclined face 44. The operating member 53 can be pivoted relative to the main body 51 by the bending of the thin hinge 52. As shown in FIG. 2, when the detecting member 50 is in the waiting position, the hinge 52 is in a slightly bent state, and a lower face of the operating member 53 makes contact with the guiding inclined face 44. The operating member 53 is thus supported in a pivoted state relative to the main body 51. That is, the resilience of the hinge 52 supports the operating member 53 in a state whereby an anterior end of the lower face of this operating member 53 is raised slightly above the guiding inclined face 44, and only a posterior end of this lower face makes contact with the guiding inclined face 44. As a result, the angle of inclination of the operating member 53 relative to the main body 51 is slightly less than the angle of inclination of the guiding inclined face 44. A posterior end face of the operating member 53 is inclined at a specified angle (the angle of inclination of the operating member 53 relative to the main body 51) relative to a posterior end face of the locking arm 33, being inclined upwards with reference to FIG. 2. Moreover, a lower portion of the posterior end of the operating member 53 protrudes slightly to the posterior relative to the posterior end of the locking arm 33, and an edge of the upper portion of the posterior end of the operating member 53 protrudes upwards relative to the protecting walls 37. Consequently, the detecting member 50 can be seen from the side when it is in the waiting position.

Figure 5:
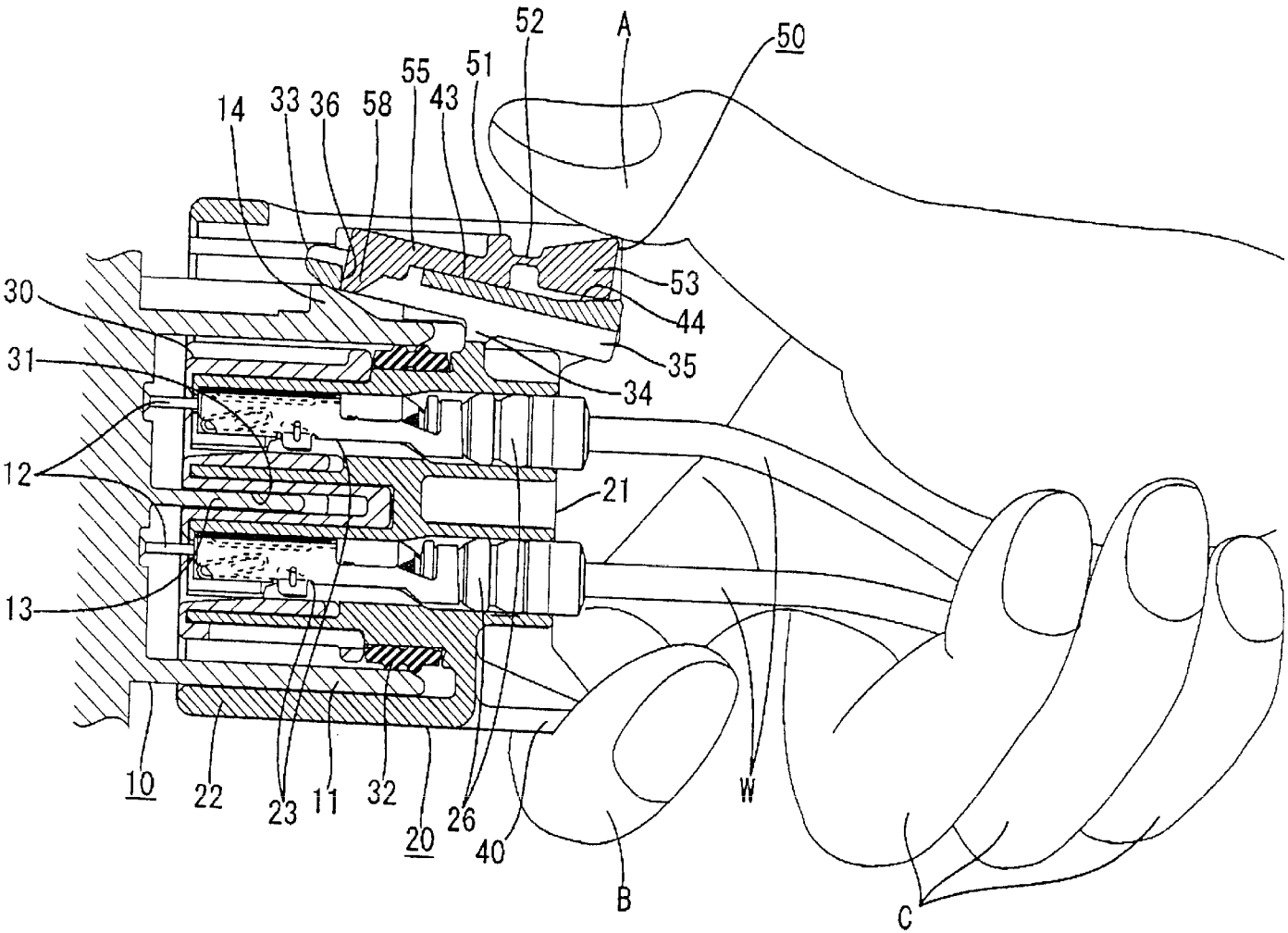
FIG. 5 is a side cross-sectional view showing the two housings while they are being fitted together.

As shown in FIG. 5, when the two housings 10 and 20 are being fitted together, three fingers C gather together the electric wires W led out towards the posterior from the posterior end of the female housing 20 while an anteriorly-located finger B (for example, an index finger) engages with the finger-engaging member 40 located at the lower side. In this state, an upper finger A (for example, a thumb) engages with the operating member 53 of the detecting member 50 that is in the waiting position, engaging with the area of this operating member 53 that extends from the upper edge to the posterior end face thereof. When the detecting member 50 is to be moved, the thumb A, which is engaged with the operating member 53, pushes downwards in the direction shown by the arrow Y in FIG. 6. The direction in which the thumb A pushes (i.e., the direction whereby one pushes in the detecting member 50) is a downwardly inclined direction which extends along the guiding inclined face 44 and faces the direction of movement of the detecting member 50.

Figure 7:
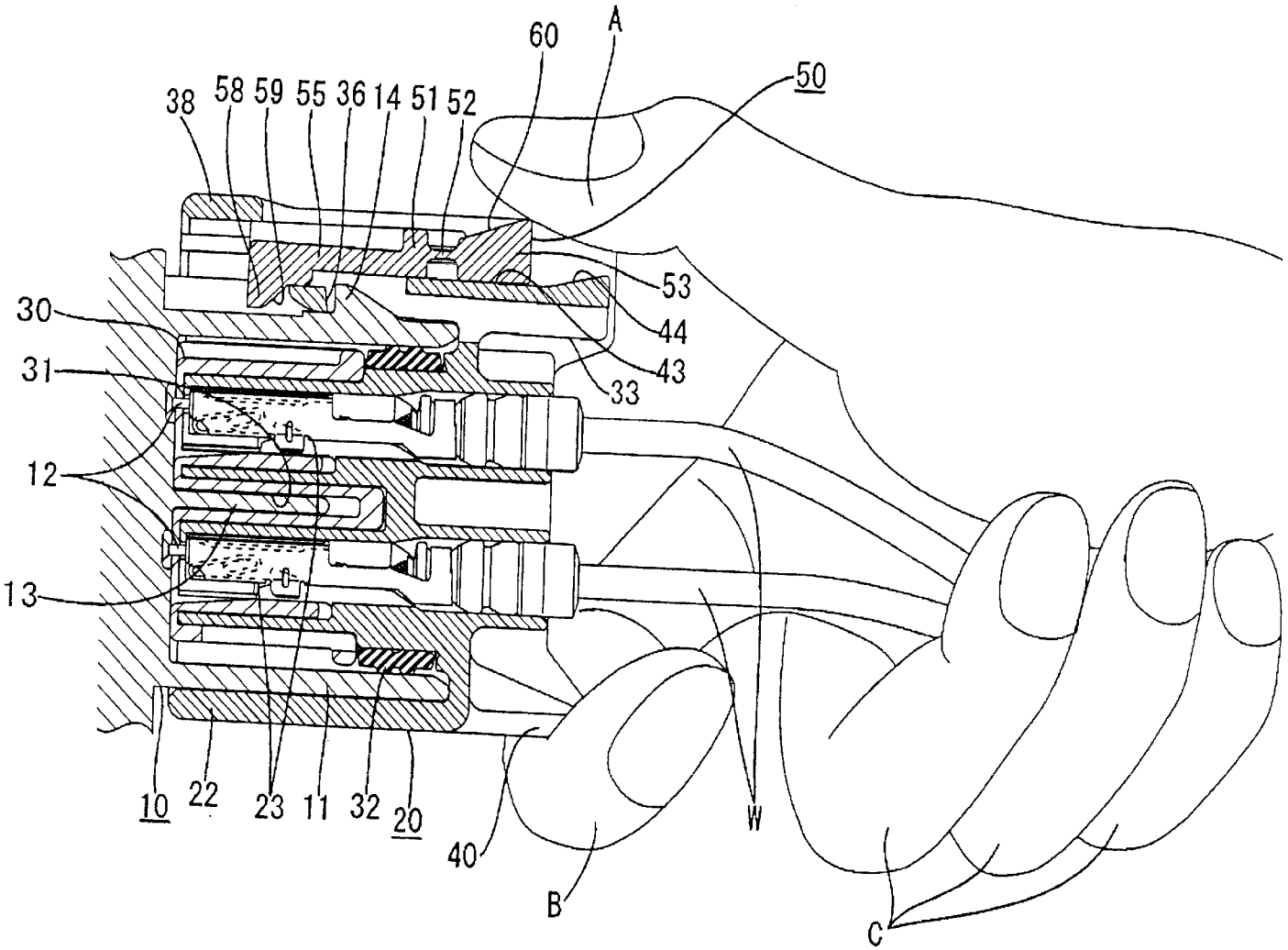
FIG. 7 is a side cross-sectional view showing the detecting member which has been moved to a detecting position.

As shown in FIG. 7, when the detecting member 50 is located in the detecting position, the entirety of the operating member 53 is located above the parallel face 43, At this juncture the lower face of the operating member 53 makes contact with the parallel face 44 that is parallel to the fitting direction, and the hinge 52 extends in an absolutely straight state. While the operating member 53 is being moved from a location above the guiding inclined face 44 to a location above the parallel face 43, the hinge 52 moves from a bent state to an absolutely straight state, this allowing the operating member 53 to pivot relative to the main body 51, the operating member 53 continuously maintaining contact with the upper face of the locking arm 33. A releasing operating face 60 located on an upper face of the operating member 53 is configured such that, when the detecting member 50 is in the detecting position, it is inclined (relative to the lower face of the releasing operating face 60) upwards towards the posterior, This simplifies the operation of moving the detecting member 50 from the detecting position to the waiting position. The angle of inclination of the releasing operating face 60, relative to its lower face, is greater than the angle of inclination of the guiding inclined face 44. Further, the edge of the upper portion of the posterior end of the operating member 53 is located at the same height as, or is slightly lower than, upper faces of the protecting walls 37. Consequently, when viewed from the side, the detecting member 50 is entirely hidden by the protecting walls 37 when it is in the detecting position.

A pair of movement preventing protrusions 61 protrude towards the sides from side faces of the operating member 53. These movement preventing protrusions 61 extend along the entire length of the operating member 53 and have a rail shape that is parallel to the fitting direction when the hinge 52 is in its absolutely straight state. Further, protruding ends of the movement preventing protrusions 61 are located in approximately the same positions as the anteriorly-located posterior stopping protrusions 56 and the anterior stopping protrusions 57. The movement preventing protrusions 61 enter the guiding grooves 41 while the detecting member 50 is being moved to the detecting position, thereby regulating the movement of the operating member 53 relative to the main body 51. That is, before the detecting member 50 has reached the detecting position, the operating member 53 can move, by means of the hinge 52, relative to the main body 51. Once the detecting member 50 has reached the detecting position, the operating member 53 is restrained by the female housing 20.

The present embodiment is configured as described above. Next, the operation thereof is described. When the detecting member 50 has been attached in the waiting position to the female housing 20, this female housing 20 is fitted to the male housing 10. At this juncture, in order to hold the female housing 20 in one hand and fit it to the male housing 10, the fitting operation may be performed as follows: the three posteriorly-located fingers C gather together into one bundle the electric wires W led out from the posterior end of the female housing 20, the index finger B engages from below with the finger-engaging member 40, and the thumb A engages with the area of the operating member 53 extending from the comer portion at the upper side thereof to the posterior end face thereof (see FIG. 5).

After the hood 11 of the male housing 10 has been fitted between the terminal housing member 21 and the outer cylindrical member 22 of the female housing 20, the male terminal fittings 12 are inserted from the anterior into the cavities 24 and the leak-preventing ribs 13 are inserted into the receiving grooves 31 of the front retainer 30. Then, as shown in FIG. 5, the anterior end portion of the locking arm 33 rises over the locking protrusion 14 while the locking arm 33 is inclined resiliently with the supporting member 34 serving as its centre. The anterior end of the locking arm 33 moves upwards, while the posterior end thereof moves downwards. The engaging arm 55 of the detecting member 50 bends resiliently upwards with the locking arm 33, moving to the same extent as the locking arm 33. In this state, the anterior end face of the engaging protrusion 58 engages with the hole edge at the anterior side of the locking hole 36. Consequently, the detecting member 50 will not move towards the anterior even if it is pushed in that direction. By this means, it can be detected that the two housings 10 and 20 are in a half-fitted state.

Figure 6:
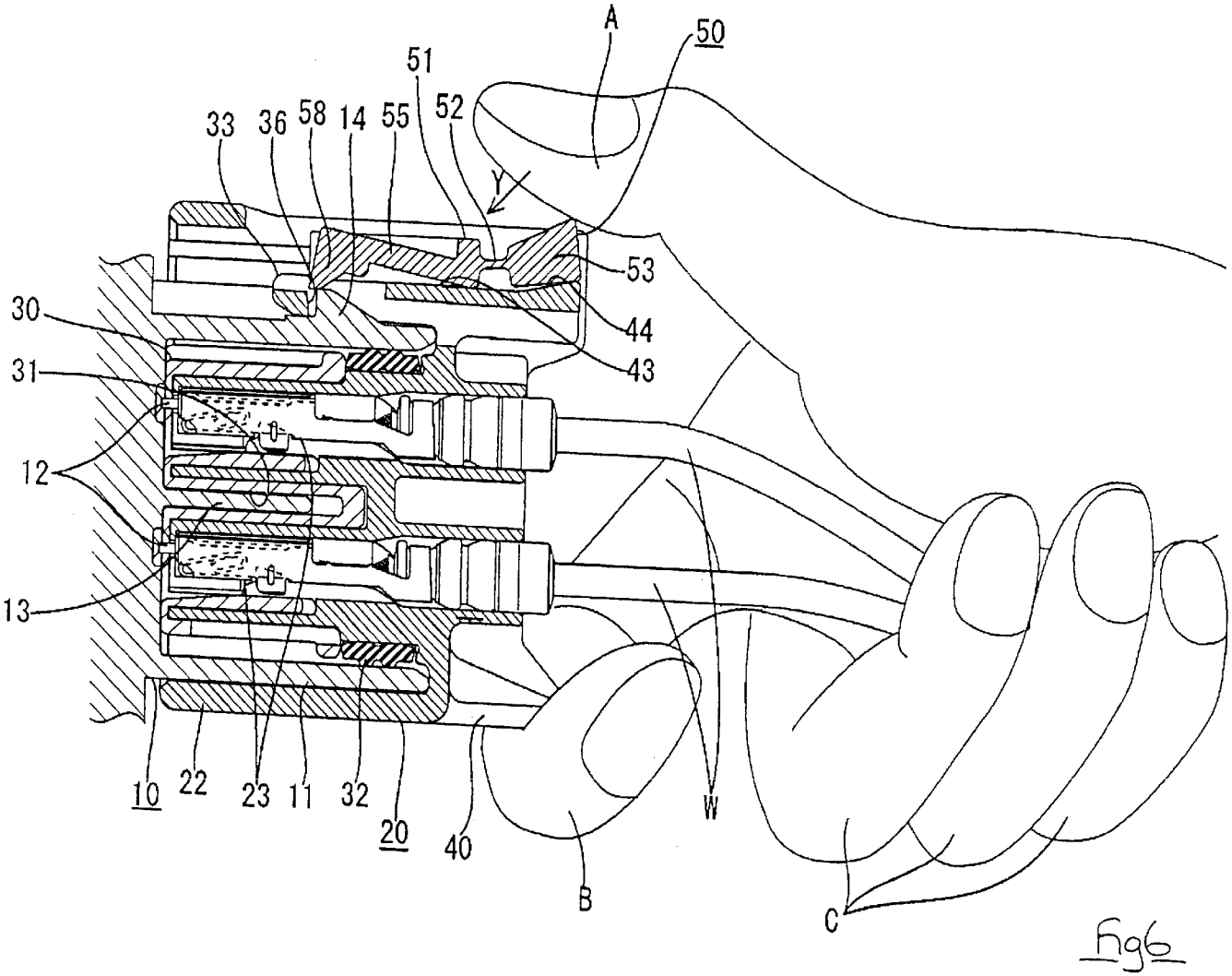
FIG. 6 is a side cross-sectional view showing the two housings in a correctly fitted state.

As shown in FIG. 6, after the two housings 10 and 20 have been fitted to a correct depth, the terminal fittings 12 and 23 reach a correct joining state, and the anterior end portion of the locking arm 33 reaches the posterior side of the locking protrusion 14, the locking arm 33 returns resiliently towards its original position, the locking protrusion 14 enters the locking hole 36, and the posterior end face of the locking protrusion 14 engages with the hole edge at the anterior side of the locking hole 36. By this means, the two housings 10 and 20 are maintained in a state whereby they cannot be separated from their correctly fitted state. At this juncture, the upper face of the hood 11 and the lower face of the locking arm 33 strike against one another, making a noise as they do so. This allows the operator to easily ascertain that the two housings 10 and 20 have been correctly fitted together. Further, the locking arm 33 does not return fully to its natural state, but is maintained in a slightly bent state. The engaging protrusion 58 of the engaging arm 55 rises over the locking protrusion 14 and returns resiliently to its original position. This engaging protrusion 58 is now entirely released from the locking hole 36 of the locking arm 33, this having already returned resiliently towards its original position. In this correctly fitted state, the rubber ring 32, which is in a slightly compressed state, fits tightly with the inner circumference face of the anterior end of the hood 11, this water-proofing the two housings 10 and 20. Further, the leak-preventing ribs 13 are fitted into the receiving grooves 31, this partitioning the mutually neighbouring male and female terminal fittings 12 and 23, and water-proofing the cavities 24.

As the fitting operation continues, the thumb A, which is engaged with the operating member 53, pushes it downwards in the direction shown by the arrow Y in FIG. 6, this pushing the detecting member 50 towards the anterior. This detecting member 50, which has now been released from its retained state with the locking arm 33, moves towards the anterior. While this movement occurs, the main body 51 moves towards the anterior in a straight manner above the parallel face 43, and the operating member 53 moves smoothly, in an inclined manner downwards and towards the anterior, along the guiding inclined face 44. At this juncture, the operating member 53 rotates relative to the main body 51 via the hinge 52, this allowing the lower face of the operating member 53 to remain constantly in contact with the guiding inclined face 44 while the operating member 53 moves. When the posterior end of the operating member 53 is located above the parallel face 43, the operating member 53 is rotated relative to the main body 51 such that the hinge 52 extends in a completely straight state, the entirety of the lower face of the operating member 53 making contact with the parallel face 43. That is, while being pushed in from the waiting position to the detecting position, the operating member 53 is constantly in contact with the guiding inclined face 44 and the parallel face 43, both of which are located at the upper face of the locking arm 33. This guides the movement of the operating member 53.

Figure 8:
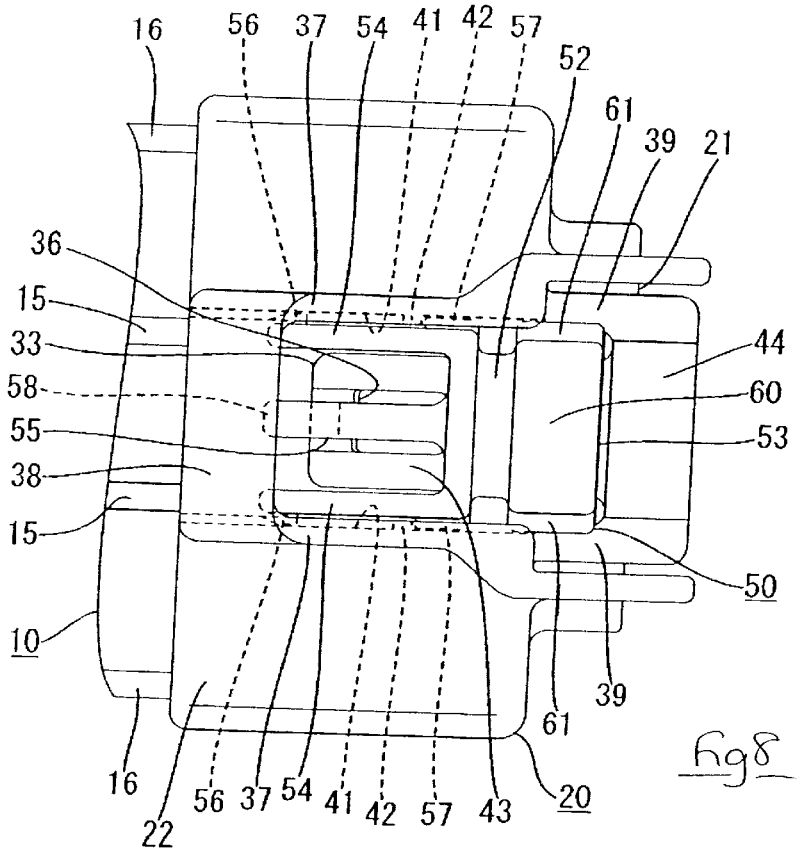
FIG. 8 is a plan view showing the detecting member which has been moved to the detecting position.
Figure 9:
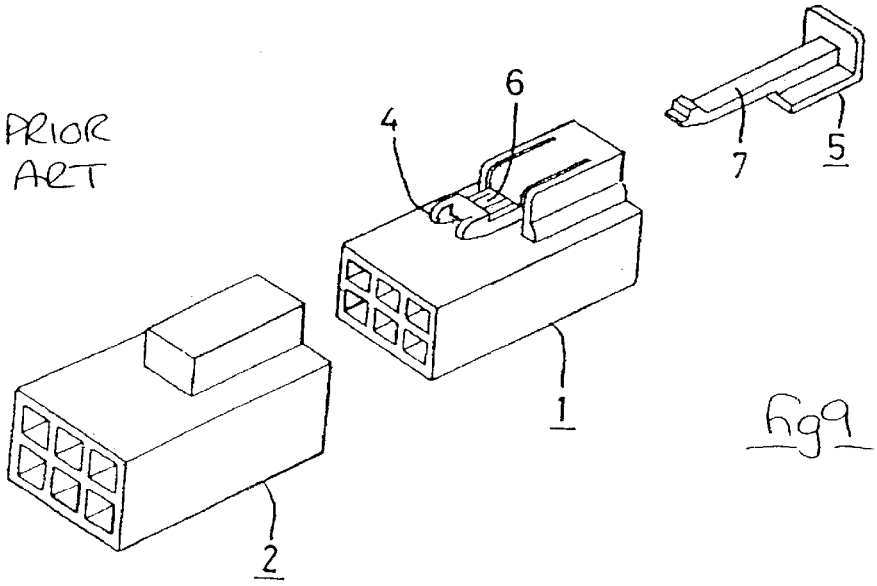
FIG. 9 is a diagonal view of a prior art example.
Figure 10:
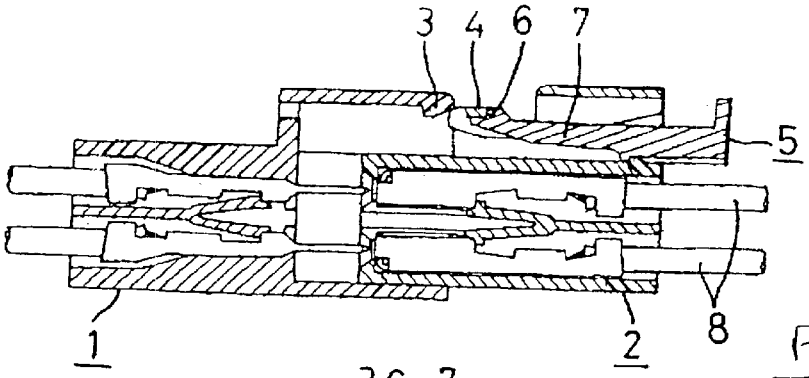
FIG. 10 is side cross-sectional views of the prior art example.
Figure 10:
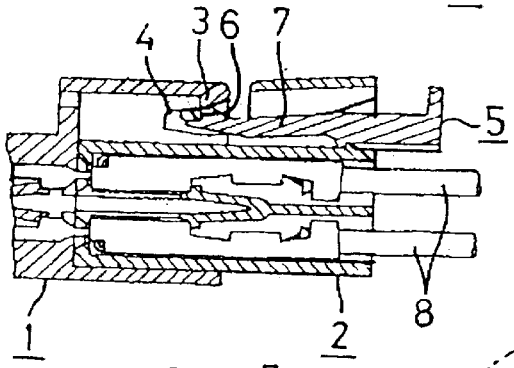
Figure 10C:
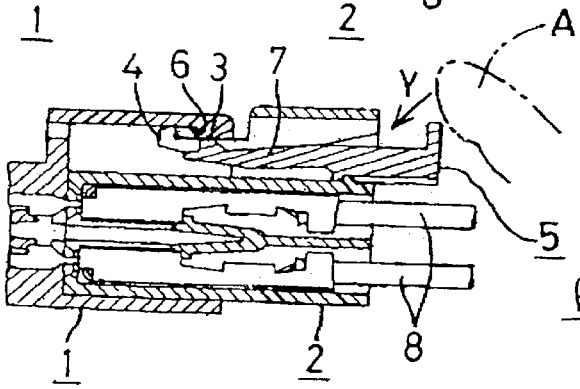
Figure 10D:
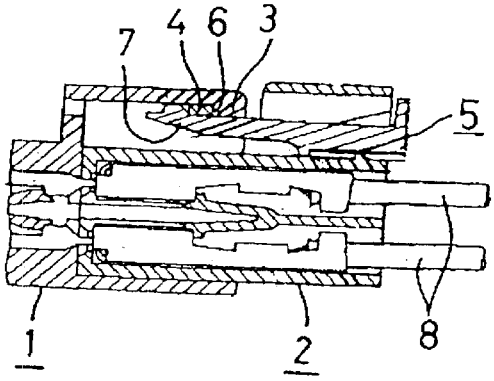
Fig 10(d) PRIOR ART

As shown in FIG. 8, when the detecting member 50 reaches the detecting position, the anterior stopping protrusions 57 engage with the stopper protrusions 42, this preventing the detecting member 50 from moving any further towards the anterior. Moreover, as shown in FIG. 7, the engaging protrusion 58 reaches a location to the anterior of the anterior end portion of the locking arm 33, the engaging arm 55 returns resiliently to its original position, and the taper-shaped posterior end face 59 of the engaging protrusion 58 engages with the anterior end face of the locking arm 33. By this means, the detecting member 50 is maintained in a semi-locked state whereby it cannot move towards the posterior from the detecting position. At this juncture, as shown in FIG. 8, the movement preventing protrusions 61 enter the guiding grooves 41, this restraining the operating member 53 in a state whereby it cannot move relative to the main body 51. Since the operating member 53 can move relative to the main body 51 before it reaches the detecting position, the inability of the operating member 53 to move allows the operator to ascertain that the detecting member 50 has reached the detecting position. Furthermore, before the detecting member 50 has reached the detecting position, the operating member 53 thereof protrudes above the protecting walls 37. By contrast, when viewed from the side, the detecting member 50 is entirely hidden by the protecting walls 37 after it has reached the detecting position. As a result, one can ascertain whether the detecting member 50 has been pushed in to the detecting position according to whether the operating member 53 thereof is visible from the side. The pushing-in operation can thus be performed reliably. Moreover, as shown in FIG. 7, the engaging arm 55 is maintained in the same kind of slightly bent state as the locking arm 33. Further, the anterior end portions of the engaging arm 55 and the guiding arms 54 have entered below the bridging member 38.

If the two housings 10 and 20 are to be separated for maintenance or the like, a finger 30 presses the releasing operating face 60 towards the posterior with a force exceeding a specified limit, the taper-shaped posterior end face 59 of the engaging protrusion 58 is released from its engaged state with the anterior end face of the locking arm 33 while the detecting member 50 moves towards the posterior, and the engaging arm 55 bends resiliently (see FIG. 6). After the detecting member 50 has been moved to the waiting position, the releasing operating face 60 is pushed downwards, and the locking arm 33 inclines resiliently with the supporting member 34 serving as its centre. The anterior end of the locking arm 33 moves upwards, the posterior end thereof moves downwards, and the locking arm 33 is released from its engaged state with the locking protrusion 14 (see FIG. 5). Then the two housings 10 and 20 are pulled apart.

In the embodiment described above, the guiding inclined face 44, along which the operating member 53 slides while the detecting member 50 is being moved, has an inclined shape which moves the operating member 53 downwards in an inclined manner along the pushing-in direction (the direction shown by the arrow in FIG. 6). Consequently, the movement of the detecting member 50 is guided smoothly, this allowing the detecting member 50 to be pushed in in a natural manner immediately after the two housings 10 and 20 have been fitted together. As a result, the assembly operation is performed in an improved, sequential, manner.

The operating member 53 can be pivoted relative to the main body 51 by means of the hinge 52. Consequently, the operating member 53 continuously maintains contact with the upper face of the locking arm 33, while moving from the guiding inclined face 44 to the parallel face 43. As a result, the movement thereof can be guided smoothly.

The operating member 53 can move continuously, via the hinge 52, relative to the main body 51 while the detecting member 50 is being moved to the detecting position. The movement preventing protrusions 61 protruding from the operating member 53 enter the guiding grooves 41 when the detecting member 50 reaches the detecting position. This restrains the operating member 53 in a state whereby it cannot move relative to the main body 51, allowing the operator to easily judge whether the detecting member 50 has reached the detecting position.

The present invention is not limited to the embodiments described above. For example, the possibilities described below also lie within the technical range of the present invention. In addition, the present invention may be embodied in various other ways without deviating from the scope thereof.

(1) In the embodiment described above, when the fitting operation takes place, the three posteriorly-located fingers of the hand holding the female housing gather the electric wires in a bundle, the index finger engages with the finger-engaging member, and the thumb engages with the operating member of the detecting member. However, the fingers need not be positioned exactly in the manner described above. For example, any fingers apart from the index finger may equally well gather the electric wires into a bundle, while the index finger engages with the operating member of the detecting member. Further, the fingers may be positioned in any other manner convenient to the operator.

(2) In the embodiment described above, the engaging arm remains engaged with the locking arm until the two housings are correctly fitted together, this maintaining the detecting member in the waiting position. However, the present invention also encompasses a configuration whereby the detecting member engages with the female housing instead of with the locking arm.

(3) In the embodiment described above, the male housing is formed in a unified manner with other apparatus. However, the male housing may equally well be, for example, of a type which is provided at ends of electric wires led out from apparatus, or this male housing may be an interrupted connector.

What is claimed is:

1. An electrical connector comprising a first connector housing engageable in a fitting direction with a mating connector housing, said first connector housing having at one side a resilient latching arm extending in the fitting direction and for engagement with the mating connector housing, said arm bending as the connector housings approach in the fitting direction and having a substantially unbent state in the fully engaged condition of the connector housings, and a detecting member being provided on said latching arm for relative movement in the fitting direction from a posterior waiting position to an anterior final position, the detecting member being maintained in the waiting position by abutment with one of said latching arm and first connector housing, and being released from abutment in the fully engaged condition of said connector housings, wherein said latching arm includes a surface inclined with respect to the fitting direction and facing towards the anterior, said detecting member being guided by said first connector housing and being slidable on the inclined surface, an operating portion of the detecting member being adapted for contact by a human finger or thumb whereby said operating portion is urged against and along the inclined surface on movement from the waiting position to the final position.

2. An electrical connector according to claim 1 wherein said detecting member comprises a main body portion connected to said operating portion by a hinge, and said latching arm includes an anterior surface extending generally parallel to said fitting direction and anterior to said inclined surface, said operating portion pivoting relative to said main body portion to be in contact with said anterior surface in the final position.

3. An electrical connector according to claim 1 and including a latch to retain said detecting member in the final position.

4. An electrical connector according to claim 1 wherein one of said detecting member and first connector housing includes opposite lateral projections guided in corresponding channels of the other of said detecting member and first connector housing.

5. An electrical connector according to claim 4 wherein said projections are provided on said detecting member.

6. An electrical connector according to claim 5 wherein opposite lateral projections are provided on said operating portion and engageable in said channels in the final position of said detecting member.

7. An electrical connector according to claim 5 wherein said channels include an abutment for engagement with a projection of said detecting member.

8. An electrical connector according to claim 1 wherein said first connector housing includes upstanding sidewalls on either side of said latching arm, said operating portion protruding above said walls in the waiting position, and not protruding above said walls in the final position.

9. An electrical connector according to claim 8 wherein said sidewalls are connected by a bridge at the anterior ends thereof.

* * * * *